US007753308B2

(12) United States Patent
Yoshioka

(10) Patent No.: US 7,753,308 B2
(45) Date of Patent: Jul. 13, 2010

(54) MECHANISM FOR PREVENTING A WINDING SLACK OF A ROLL PAPER

(75) Inventor: Yukio Yoshioka, Kawasaki (JP)

(73) Assignee: NEC Infrontia Corporation, Kanagawa (JP)

( * ) Notice: Subject to any disclaimer, the term of this patent is extended or adjusted under 35 U.S.C. 154(b) by 0 days.

(21) Appl. No.: 12/182,997

(22) Filed: Jul. 30, 2008

(65) Prior Publication Data

US 2009/0032633 A1 Feb. 5, 2009

(30) Foreign Application Priority Data

Jul. 31, 2007 (JP) ..... 2007-198837

(51) Int. Cl.
*B65H 75/00* (2006.01)

(52) U.S. Cl. ..... 242/595; 242/595.1; 242/541

(58) Field of Classification Search ..... 242/595, 242/595.1, 541, 420.1
See application file for complete search history.

(56) References Cited

U.S. PATENT DOCUMENTS 2,232,968 A * 2/1941 Price et al. ..... 242/595.1
2,243,686 A * 5/1941 Steiner et al. ..... 242/595.1
2,334,689 A * 11/1943 Wooster ..... 242/595.1
2,650,774 A * 9/1953 Krueger ..... 242/595.1
3,972,487 A * 8/1976 Costa ..... 242/558
4,494,706 A * 1/1985 Becherer et al. ..... 242/419.5
6,024,322 A * 2/2000 Skelly et al. ..... 242/563
6,135,384 A * 10/2000 Skelly et al. ..... 242/563

FOREIGN PATENT DOCUMENTS

JP 63-43047 U 3/1988
JP 63-68255 A 5/1988
JP 7-76443 A 3/1995
JP 200354790 A 2/2003
JP 2005-305895 A 11/2005
JP 3789330 B2 4/2006

* cited by examiner

*Primary Examiner*—Sang Kim
(74) *Attorney, Agent, or Firm*—Sughrue Mion, PLLC

(57) ABSTRACT

A roll paper is received in a receiving area so as to have a horizontal rolling axis. In the vicinity of a lowest part of the receiving area, an inclined surface faces the receiving area. At a position being lower than the inclined surface, a rotation making member is placed to face the receiving area. In such arrangement, the inclined surface makes the roll paper be slid towards the lowest part of the receiving area when the inclined surface receives the roll paper that is out of the receiving area. In response to movement of the roll paper towards the lowest part of the receiving area, the rotation making member rotates the roll paper around the horizontal rolling axis towards a winding direction of the roll paper.

11 Claims, 3 Drawing Sheets

MECHANISM FOR PREVENTING A WINDING SLACK OF A ROLL PAPER

This application is based upon and claims the benefit of priority from Japanese patent application No. 2007-198837, filed on Jul. 31, 2007, the disclosure of which is incorporated herein in its entirely by reference.

TECHNICAL FIELD

This invention relates to a mechanism for preventing a winding slack of a roll paper and can be employed in an electronic cash register or the like that is subjected to the occurrence of a paper jam in a printer.

BACKGROUND ART

A conventional electronic cash register is provided with a mechanism for preventing a winding slack of a roll paper as disclosed in Japanese Unexamined Patent Application Publication (JP-A) No. 2003-54790). The electronic cash register comprises a device body having a hollow structure that is open at its front and a drawer box open at its top is mounted in the device body so as to be slidable forward and backward. The device body comprises a ticket printer which is provided with a medium holding device for holding the roll paper.

When the drawer box is moved forward and backward, an impact thereof is exerted even on the medium holding device from the device body so that there occurs a case where the wound portion of the roll paper separates from a holding roller included in the medium holding device.

In such a case, slack may occur in the roll paper to cause a paper jam, but in the medium holding device, the wound portion of the roll paper separating from the holding roller falls down so that the wound portion automatically rotates in its winding direction to cancel the slack.

Accordingly, since the electronic cash register is not subjected to the occurrence of slack of the roll paper held by the medium holding device even if the drawer box is moved, the ticket can be well issued by the ticket printer.

SUMMARY OF THE INVENTION

In the foregoing conventional mechanism, it is difficult for the holding roller to rotate in the case where the diameter of the wound portion is small. Consequently, the winding slack of the roll paper is not sufficiently eliminated.

It is therefore an exemplary object of this invention to provide a roll paper winding slack preventing mechanism that can eliminate winding slack of roll paper when a wound portion of the roll paper is displaced due to vibration or impact, regardless of the magnitude of the diameter of the wound portion.

Other objects of the present invention will become clear as the description proceeds.

According to an exemplary aspect of the present invention, there is provided a roll paper winding slack preventing mechanism, wherein a first rotation support member, a second rotation support member, and an inclined surface are provided in a housing, the second rotation support member is disposed in the housing so as to be rotatable on its own axis and movable in a horizontal direction, a position of the first rotation support member is set higher than that of the second rotation support member and the position of the second rotation support member is set lower than that of the inclined surface, when roll paper is held in the housing with no winding slack, a wound portion of the roll paper is supported by the first rotation support member and the second rotation support member, and the first rotation support member and the second rotation support member rotate in one direction, respectively, and when the wound portion of the roll paper is displaced due to vibration or impact, the wound portion of the roll paper rides on the inclined surface and then slides down the inclined surface to push the second rotation support member so that the second rotation support member rotates in a direction opposite to the one direction and moves in the horizontal direction, while the wound portion of the roll paper rotates in a direction to eliminate winding slack of the roll paper.

According to another exemplary aspect of the present invention, there is provided a printer comprising the roll paper winding slack preventing mechanism described above.

According to still another exemplary aspect of the present invention, there is provided a mechanism for handling a roll paper, comprising a receiving area for receiving the roll paper to have a horizontal rolling axis, an inclined surface which faces the receiving area in the vicinity of a lowest part of the receiving area, and a rotation making member which faces the receiving area at a position being lower than the inclined surface, wherein the inclined surface makes the roll paper be slid towards the lowest part of the receiving area when the inclined surface receives the roll paper that is out of the receiving area, and wherein the rotation making member rotates the roll paper around the horizontal rolling axis towards a winding direction of the roll paper in response to movement of the roll paper towards the lowest part of the receiving area.

DESCRIPTION OF THE EXEMPLARY EMBODIMENT

Figure 1:
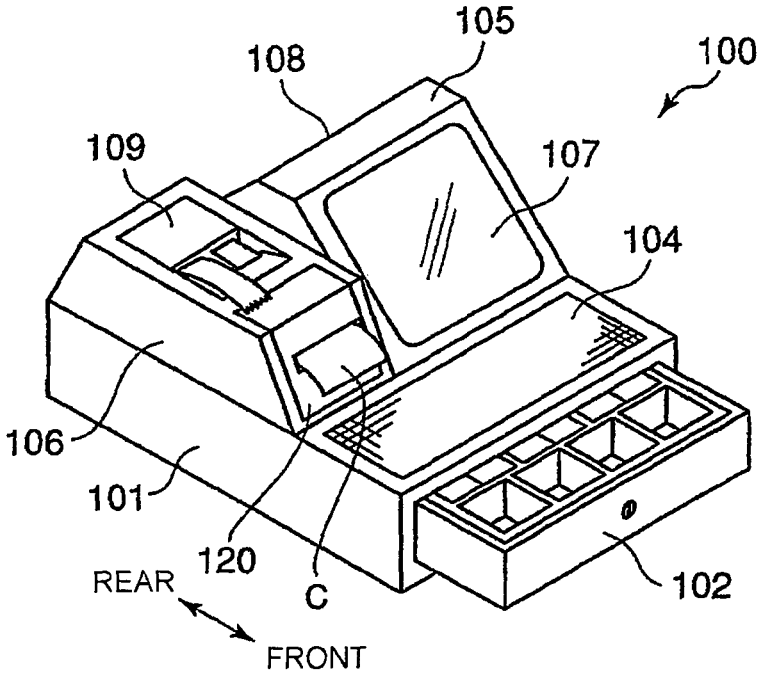
FIG. 1 is a perspective view showing an electronic cash register comprising a ticket printer to which the present invention is applicable.
Figure 2:
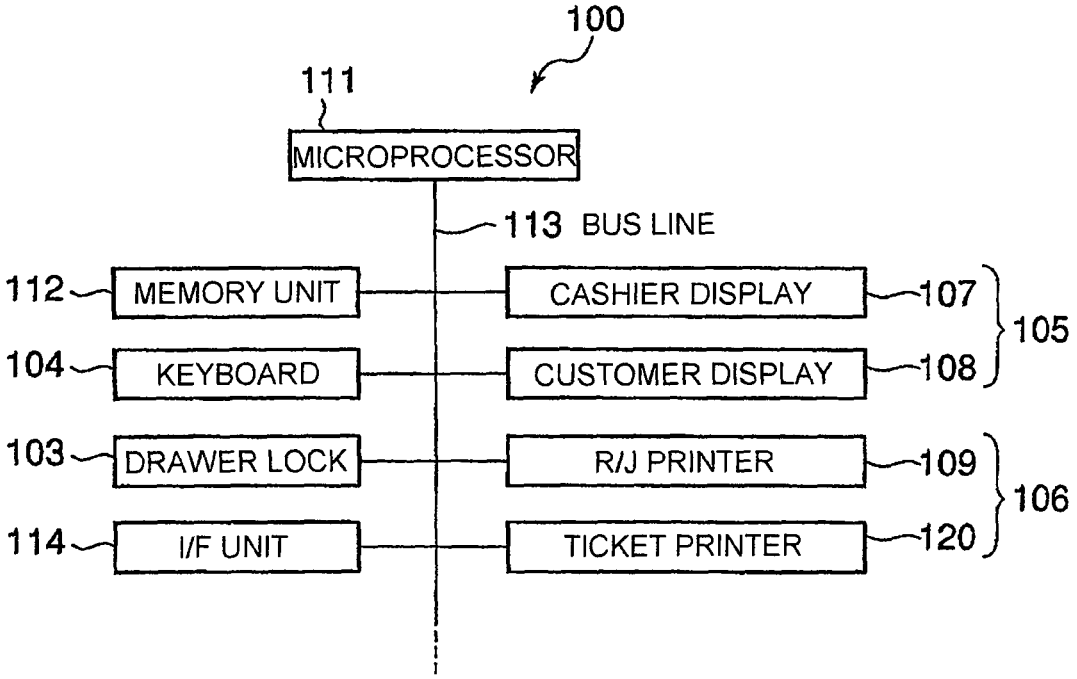
FIG. 2 is a block diagram showing a circuit configuration of the electronic cash register illustrated in FIG. 1.

With reference to FIGS. 1 and 2, description will be made as regards an electronic cash register comprising a ticket printer to which an embodiment of the present invention is applicable.

In FIG. 1, an electronic cash register 100 comprises a flat device body 101 having a hollow structure that is open at its front and a drawer box 102 open at its top is mounted in the device body 101 so as to be slidable forward and backward. In the rear part of the device body 101, there are disposed a non-illustrated drawer spring resiliently urging forward the drawer box 102 received in the device body 101 and a non-illustrated drawer lock 103 (see FIG. 2) releasably holding the drawer box 102 against the pressure of the drawer spring.

A keyboard 104 serving as information input means is integrally provided on the top front side of the device body 101, and a display unit 105 and a printer unit 106 are provided side by side on the rear side of the keyboard 104. The display unit 105 has a front surface, inclined backward, provided with a cashier display 107 and a rear surface, inclined forward, provided with a customer display 108. The printer unit 106 has an R/J (Receipt/Journal) printer 109 incorporated in the rear part thereof and a ticket printer 120, serving as an image printing apparatus, incorporated in the front part thereof.

As shown in FIG. 2, the electronic cash register 100 further comprises a microprocessor 111 serving as item registration means and a memory unit 112 serving as information storage means, which are connected to the drawer lock 103, the keyboard 104, the cashier display 107, the customer display 108, the R/J printer 109, the ticket printer 120, and an I/F unit 114 through a bus line 113.

The memory unit 112 stores in advance item information pieces, each including at least an item code and a selling price, for a large number of selling items, respectively. In response to an item code inputted from the keyboard 104 or the like, the microprocessor 111 reads a corresponding item information piece from the memory unit 112, thereby performing a registration process.

Figure 3:
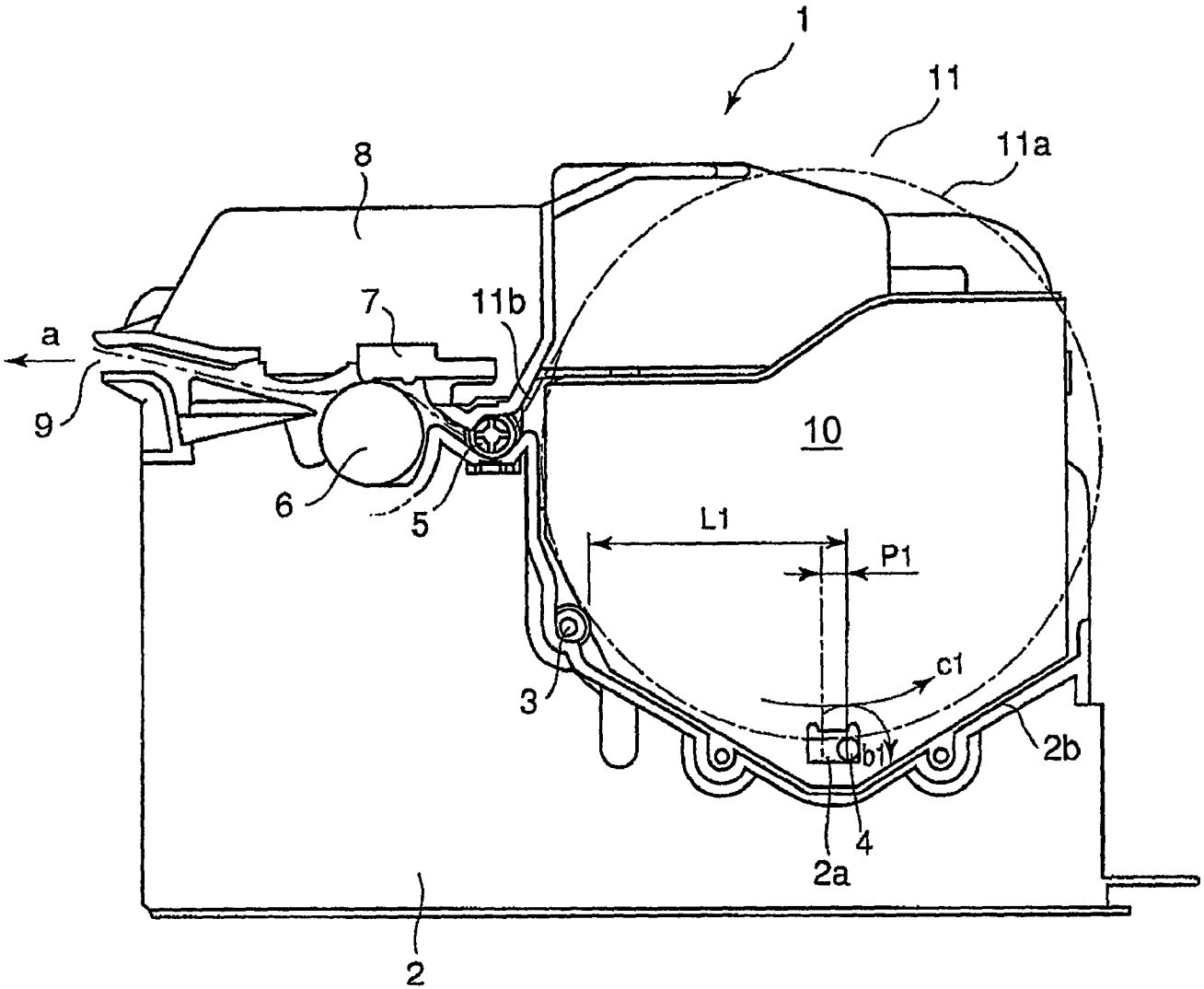
FIG. 3 is a sectional view of the ticket printer showing a normal state where no winding slack occurs in a roll paper.
Figure 4:
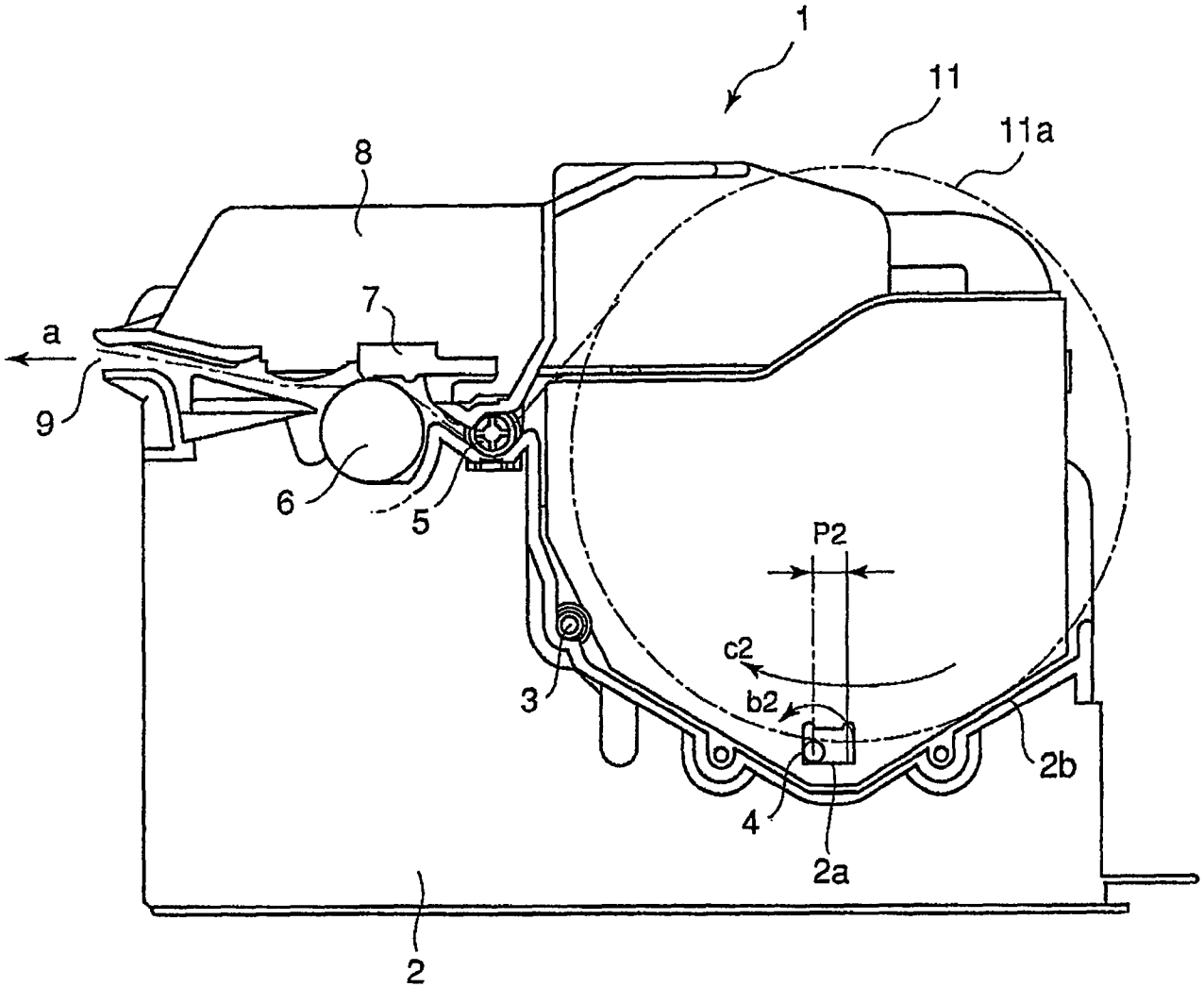
FIG. 4 is a sectional view of the ticket printer showing a transitional state where the roll paper is subjected to the occurrence of winding slack and is on the way of restoration toward the normal state.

With reference to FIGS. 3 and 4, the description will be directed to the ticket printer.

FIG. 3 shows a normal state where no winding slack occurs in ticket roll paper 11 held by a ticket printer 1. FIG. 4 shows a transitional state where winding slack occurring in the ticket roll paper 11 is on the way to be automatically eliminated.

In FIG. 3, the ticket printer 3 comprises a housing 2 defining a receiving area 10 for receiving the ticket roll paper 11 to have a horizontal rolling axis. In the housing 2, a roller 3 and a movable shaft 4 are disposed to face the receiving area 10. The ticket roll paper 11 is placed on the roller 3 and the movable shaft 4 in the receiving area 10. In other words, the roller 3 and the movable shaft 4 are cooperated with to each other to maintain the ticket roll paper 11 in the receiving area 10. The roller 3 is located at a position higher than that of the movable shaft 4 that is located at a lowest part of the receiving area 10. The movable shaft 4 is held in a pair of generally rectangular holes 2*a* formed in the housing 2 on both front and rear sides thereof, so as to be rotatable on its own axis and movable in a horizontal direction perpendicular to the above-mentioned horizontal rolling axis. More particularly, the movable shaft 4 frictionally engages with the lower edges of the holes 2*a* so as to rotate in response to movement along the edges.

The distance in the horizontal direction between portions where a wound portion 11*a* of the ticket roll paper 11 is in contact with the roller 3 and the movable shaft 4, respectively, is given by L1. The movable shaft 4 is offset both in the horizontal direction and in the vertical direction from the center (i.e. the center of gravity) of the wound portion 11*a* of the ticket roll paper 11. The offset distance in the horizontal direction is given by P1.

A conveying portion 5, a platen 6, and a head 7 are also disposed in the housing 2. A cover 8 is provided at the top of the housing 2 so as to be openable and closable.

The ticket roll paper 11 is conveyed in a direction of arrow a by the conveying portion 5 and is printed when passing between the platen 6 and the head 7, and then a tip 11*b* of the ticket roll paper 11 is drawn out of a paper outlet 9. In this event, the wound portion 11*a* rotates in a direction of arrow c1 and the movable shaft 4 rotates in a direction of arrow b1.

FIG. 4 shows the transitional state where the wound portion 11*a* of the ticket roll paper 11, once displaced in the right direction due to vibration or impact in the normal state of FIG. 3, is on the way to be restored to the normal state. The wound portion 11*a* of the ticket roll paper 11 is placed on the movable shaft 4 and an inclined surface 2*b* of the housing 2. The inclined surface 2*b* is placed in the vicinity of and higher that the lowest part of the receiving area 10. The position of the movable shaft 4 is lower than a position where the wound portion 11*a* of the ticket roll paper 11 is in contact with the inclined surface 2*b* of the housing 2.

The wound portion 11*a* of the ticket roll paper 11 is displaced rightward or out of receiving area 10 due to vibration or impact to ride on the inclined surface 2*b* of the housing 2, thereby causing winding slack. Subsequently, the wound portion 11*a* of the ticket roll paper 11 slides down the inclined surface 2*b* in a lower-left direction by its own weight. The frictional resistance between the movable shaft 4 and the ticket roll paper 11 is greater than that between the ticket roll paper 11 and the inclined surface 2*b*. Therefore, the movable shaft 4 is pushed by the wound portion 11*a* of the ticket roll paper 11 to move in the holes 2*a* from the position of FIG. 3 (right end of the hole 2*a*) to the position of FIG. 4 (left end of the hole 2*a*) while rotating in a direction of arrow b2. It is noted here that the hole 2*a* restricts a movable range of the movable shaft 4 in the horizontal direction. In this event, the wound portion 11*a*, being in frictional contact with the movable shaft 4, of the ticket roll paper 11 rotates in a direction of arrow c2 so that the winding slack is automatically eliminated. Even when the movable shaft 4 is brought into contact with the left end of the hole 2*a* (see FIG. 4), the wound portion 11*a* continues to rotate in the direction of arrow c2 for a while. In this event, the movable shaft 4 rotates the roll paper around the horizontal rolling axis towards a winding direction of the ticket roll paper 11 in response to movement of the ticket roll paper 11 towards the lowest part of the receiving area 10 and therefore is referred to a rotation making member.

In this manner, in the ticket printer 1, the winding slack of the ticket roll paper 11 is eliminated and thus a paper jam due to winding slack is prevented.

In FIG. 4, the offset distance in the horizontal direction from the center of the movable shaft 4 being in contact with the left end of the hole 2*a* to the center of the wound portion 11*a* of the ticket roll paper 11 is given by P2.

When the conveying portion 5 conveys the ticket roll paper 11 after the winding slack of the ticket roll paper 11 is eliminated, the wound portion 11*a* of the ticket roll paper 11 rotates counterclockwise. Then, the movable shaft 4 moves from the left end to the right end of the hole 2*a* while rotating clockwise and the outer periphery of the wound portion 11*a* is brought into contact with the roller 3, so that the wound portion 11*a* is restored to the state of FIG. 3.

If the ticket roll paper 11 is subjected to a large number of times of printing and vibration or impact loads, the wound portion 11*a* of the ticket roller paper 11 reciprocates between the position of FIG. 3 and the position of FIG. 4. If the offset distances are set to P2>P1, the wound portion 11*a* tends to be maintained at the position of FIG. 4.

In the embodiment described above, a design change may be performed so that the roller 3 is replaced with a rotation support member such as a ball bearing or a needle bearing.

Further, a design change may be performed so that the movable shaft 4 in the form of the simple single cylindrical shaft is replaced with a rotation support member.

Further, instead of being formed in the housing 2 itself, the generally rectangular holes 2*a* may be formed in separate members.

Further, instead of being formed in the housing 2 itself, the inclined surface 2*b* may be formed using a separate member.

Further, although the type of the printer in the foregoing embodiment is a ticket printer, this invention is also applicable to receipt printers, journal printers, and various other apparatuses using roll paper.

According to the embodiment and modifications described above, the following results can be obtained.

1. Since the second rotation support member is disposed in the housing so as to be rotatable on its own axis and movable in the horizontal direction, when the wound portion of the roll paper is displaced due to vibration or impact, the wound portion can smoothly move rotationally regardless of the magnitude of the diameter thereof, so that the winding slack of the roll paper is eliminated.

2. Since the first rotation support member is a roller, the wound portion of the roll paper can rotate with a frictional resistance which is small, and further, the structure is simple.

3. Since the second rotation support member is a cylindrical shaft, the wound portion of the roll paper can move rotationally with a frictional resistance which is small, and further, the structure is simple.

4. Since the second rotation support member is disposed in the generally rectangular holes formed in the housing or the separate members, the disposition structure is simple.

5. Since the inclined surface is formed in the housing or using the separate member, the support structure for the wound portion of the roll paper is simple.

6. In the printer having the roll paper winding slack preventing mechanism of this invention, no paper jam occurs regardless of the magnitude of the diameter of the wound portion of the roll paper.

While the invention has been particularly shown and described with reference to exemplary embodiments thereof, the invention is not limited to these embodiments. It will be understood by those of ordinary skill in the art that various changes in form and details may be made therein without departing from the spirit and scope of the present invention as defined by the claims.

What is claimed is:

1. A roll paper winding slack preventing mechanism, wherein a first rotation support member, a second rotation support member, and an inclined surface are provided in a housing, said second rotation support member is disposed in said housing so as to be rotatable on its own axis and movable in a horizontal direction, a position of said first rotation support member is set higher than that of said second rotation support member and the position of said second rotation support member is set lower than that of said inclined surface, when a roll paper is held in said housing with no winding slack, a wound portion of said roll paper is supported by said first rotation support member and said second rotation support member, and said first rotation support member and said second rotation support member rotate in one direction, respectively, and when said wound portion of the roll paper is displaced due to vibration or impact, said wound portion of the roll paper rides on said inclined surface and then slides down said inclined surface to push said second rotation support member so that said second rotation support member rotates in a direction opposite to said one direction and moves in the horizontal direction, while said wound portion of the roll paper rotates in a direction to eliminate winding slack of said roll paper.

2. The roll paper winding slack preventing mechanism according to claim 1, wherein said first rotation support member is a roller.

3. The roll paper winding slack preventing mechanism according to claim 1, wherein said second rotation support member is a cylindrical shaft.

4. The roll paper winding slack preventing mechanism according to claim 1, wherein said second rotation support member is disposed so as to be rotatable on its own axis and movable in the horizontal direction in a generally rectangular hole formed in said housing or a separate member.

5. The roll paper winding slack preventing mechanism according to claim 1, wherein said inclined surface is formed in said housing or using a separate member.

6. A printer comprising the roll paper winding slack preventing mechanism according to claim 1.

7. A mechanism for handling a roll paper, comprising:

a receiving area for receiving the roll paper to have a horizontal rolling axis;

an inclined surface which faces the receiving area in the vicinity of a lowest part of the receiving area; and a rotation making member which faces the receiving area at a position being lower than the inclined surface;

wherein the inclined surface makes the roll paper be slid towards the lowest part of the receiving area when the inclined surface receives the roll paper that is out of the receiving area;

wherein the rotation making member rotates the roll paper around the horizontal rolling axis towards a winding direction of the roll paper in response to movement of the roll paper towards the lowest part of the receiving area; and wherein the rotation making member comprises a movable shaft which is movable in a horizontal direction perpendicular to the horizontal rolling axis, and the movable shaft rotates in accordance with movement thereof to rotate the roll paper towards the winding direction.

8. The mechanism according to claim 7, further comprising a housing which defines the receiving area and having an edge defining a hole receiving the movable shaft therein, wherein the movable shaft frictionally engages with the age so as to rotate in response to movement along the edge.

9. The mechanism according to claim 8, wherein the hole restricts a movable range of the movable shaft in the horizontal direction.

10. The mechanism according to claim 7, further comprising a support member which faces the receiving area at a position being higher than the rotation making member, wherein the rotation making member is placed between the inclined surface and the supporting member.

11. The mechanism according to claim 10, wherein the support member and the rotation making member are apart from to each other and cooperated with to each other to maintain the roll paper in the receiving area.

* * * * *